US006108917A

United States Patent [19]

Bellis et al.

[11] Patent Number: 6,108,917

[45] Date of Patent: Aug. 29, 2000

[54] HACCP CAN OPENER

[76] Inventors: Mark G. Bellis, 384 Chestnut St.; Marla J. Bellis, 384 Chestnut, both of Los Banos, Calif. 93635

[21] Appl. No.: 09/196,712

[22] Filed: Nov. 20, 1998

Related U.S. Application Data

[60] Provisional application No. 60/066,711, Nov. 21, 1997.

[51] Int. Cl.[7] ..... B67B 7/46

[52] U.S. Cl. ..... 30/417; 30/418; 30/423; 30/434

[58] Field of Search ..... 30/417–418, 422, 30/424–427, 434, 440–441

[56] References Cited

U.S. PATENT DOCUMENTS 1,434,323 10/1922 Bauer .
1,443,783 1/1923 Bauer et al. .
1,539,211 5/1925 Scruggs ..... 330/418
1,684,414 9/1928 Rydquist .
2,728,983 1/1956 Mugavero .
3,006,070 10/1961 Nordquist .
4,251,917 2/1981 Peres .
4,604,806 8/1986 Pelezynski .

*Primary Examiner*—Douglas D. Watts
*Attorney, Agent, or Firm*—Mark D. Miller

[57] ABSTRACT

Disclosed is a safe and reliable method and apparatus for opening cylindrical metallic containers which cuts into the side of the cylindrical body of the can below the upper annular rim. The device of the present invention employs a specially adapted, angularly-positioned, tapered rotatable blade for performing the cutting operation. The use of a rotatable blade results in a clean non-jagged cut around the circumference of the container. The use of a rotatable, tapered blade to cut below the annular rim or seam of the container results in an inwardly-bent edge on the newly-cut lid having no sharp edges. This facilitates easy and worry free removal of the lid. In use, a can is placed in the device such that the knurled edge of an upper disc rests upon the top of the can. The rotatable side cutting blade is then moved such that it pierces the side of the can, just below the lip seal. The side cutting blade is locked into place, and the upper disc is rotated, thereby rotating the can. As this takes place, the rotatable side cutting blade cuts the top off the can.

4 Claims, 6 Drawing Sheets

HACCP CAN OPENER

This application claims benefit of Provisional Application 60/066,711 filed Nov. 21, 1997.

BACKGROUND OF THE INVENTION

1. Field of the Invention

The present invention relates to can openers, and more particularly to a new and improved HACCP-compatible device which opens a can using a specially adapted blade which cuts through the body of the can or drum just below the rim.

2. Description of the Prior Art

Numerous metal can and drum openers are known in the art. Many can openers employ the use of a sharpened triangular cutting blade which is forcibly punctured into the top inside lip of a sealed can. Once punctured, a gear outside the can rotates the can by use of a hand-crank or motor. As the can is rotated, the blade cuts a path around the inside lip until the lid separates from the body of the can. In many cases, when this process is complete, the sharp-edged newly-cut lid is free to fall into the top of the can.

Top cutting can openers suffer from two serious defects. First, any debris that is not cleaned off the top of the can could be easily introduced into the contents of the can. If the contents are a comestible material, the consumer of those contents may be exposed to bacteria, germs or disease from the top of the can. Secondly, should such a sharp-edged lid fall into the can, the user may be cut or injured when handling the lid. This is of particular concern should the lid fall into the comestible material, and the user cuts a finger while removing it. This could expose the contents to blood borne diseases of the user. It is therefore desirable to have a can opener which avoids the dangers presented by a lid which can fall into the contents of the can, or which can cut the fingers of the user.

Numerous side cutting can and drum openers have also been developed in the prior art. Some of these devices such as those disclosed in U.S. Pat. Nos. 3,006,070, 4,251,917 and 4,604,806 are designed to cut into the end seam or rim of the can, not underneath. This is undesirable in that modern can sealing methods include the application of adhesive during the sealing process which retains some flexibility after it has cooled. A cut into the seam will cut directly into this adhesive which still retains some of its adhesive properties, making the newly-cut lid difficult to remove from the can.

Other side cutting can openers such as those disclosed in U.S. Pat. Nos. 1,434,323, 1,443,783, 1,684,414 and 2,728,983 cut into the cylindrical body of the can below the rim or seam. The devices disclosed in the '323 and '783 patents use flat-edged cutting disks which leave a jagged edge on the newly-cut lid. The device of the '983 patent is not well designed in that it cuts into an inverted can thereby allowing the contents of the can to spill during the opening operation. The '414 device creates a lid having very sharp edges, and employs the cumbersome use of a turn knob which must be engaged before cutting and disengaged after cutting the can. None of the above patents provide support for the can once the cutting operation is completed.

SUMMARY OF THE INVENTION

The present invention provides a novel, safe and reliable apparatus for opening a cylindrical metallic container (a can) by cutting into the side of the cylindrical body of the can below the upper annular rim. The device of the present invention employs a specially adapted, angularly-positioned, tapered rotatable blade for performing the cutting operation. The use of a rotatable blade results in a clean non-jagged cut around the circumference of the can. The use of a rotatable, tapered blade to cut below the annular rim or seam of the can results in an inwardly-bent edge on the newly-cut lid having no sharp edges. This facilitates easy and worry free removal of the lid.

The blade is shuttle mounted such that it may be moved between a retracted and extended position. In this way, it is the blade that is moved in order to puncture the can, instead of the can being pushed into a stationary blade. The blade mount is also offset with respect to the center of the device in order to more readily facilitate the cutting operation. The offset positioning helps force the can into the blade, instead of away from it, during the cutting operation. The present invention also provides adequate support for the can to be held in an upright position before, during and after the cutting operation. This allows the lid to remain resting on the top of the can even after it has been completely severed therefrom.

The HACCP (hazardous analysis critical control point) can opener does not de-lid by puncturing the inner lid, but by making a smooth cut along the under-side of the top outer annular lip. A gear having a knurled edge rotatably attached to the head assembly of the opener is positioned inside the top lid of the sealed can. Its purpose is to act as a guide for the cutting wheel positioned on the under-side of the top outer annular lip. When lifted, the head assembly separates the guide gear and the cutting wheel to position the can. When the head assembly is lowered, the wheel and guide are forced together gripping the can at the top lip.

The blade is angularly mounted on a movable assembly which shuttles between retracted and extended positions. After the head assembly is lowered onto the can, the blade is moved to the extended position, thereby piercing the side of the can, just below the seam of the annular lip. Then, as the hand-crank is turned, the can is rotated and the blade cuts around the entire can just below the lip. Once the cutting operation is complete, the blade is retracted, and the head assembly is lifted to allow the removal of the can from the opener. The lid and lip are simply lifted off the top of the can as a single piece without danger of injury to the handler or contamination to the contents.

The HACCP can opener is designed, when used properly, to not introduce foreign material into the product stream. It consists of a foot, neck, head, and arm. The foot is designed to be mounted to a table, counter, or other stable platform. There is an opening in the foot to fit the neck and allow free vertical movement to accommodate a variety of can sizes. Around the entrance of the neck fitting is a reinforced extension to provide added stability to the neck.

The neck, head, and arm act as a single unit (the head assembly). The neck is designed to move vertically in the foot depending on the size of the can to be opened. Permanently mounted to the top of the neck is the head assembly which holds the actual opening/cutting mechanism. Fitted into the head assembly is a guide gear that, when a can is placed adjacent to it, will rotate against the upper inner annular lip of the can gripping it so the can will turn and the cutting wheel severs the lid. A crank arm positioned above the head, is manually rotated forcing the cutting action. When the lever is disengaged and the head is raised, the can is removed. This is the position that allows placement or removal of a can from the device.

A motor or other automatic means may be employed to operate the crank to rotate the guide gear of the invention.

It is therefore a primary object of the present invention to provide a easy, safe and efficient apparatus for opening cylindrical metallic containers which makes a clean circumferential cut into the side of the cylindrical body of the container just below the upper rim or seam.

It is also an important object of the present invention to provide an apparatus for efficiently opening cylindrical metallic containers by cutting off a "lid" therefrom such that the lid is devoid of sharp edges.

It is another object of the present invention to provide an opener for cylindrical metallic containers such as number 10 cans which avoids the introduction of undesired exterior substances into the contents of the can during the opening operation.

Other objects of the invention will be apparent from the detailed descriptions and the claims herein.

DETAILED DESCRIPTION OF THE PREFERRED EMBODIMENT

Figure 1:
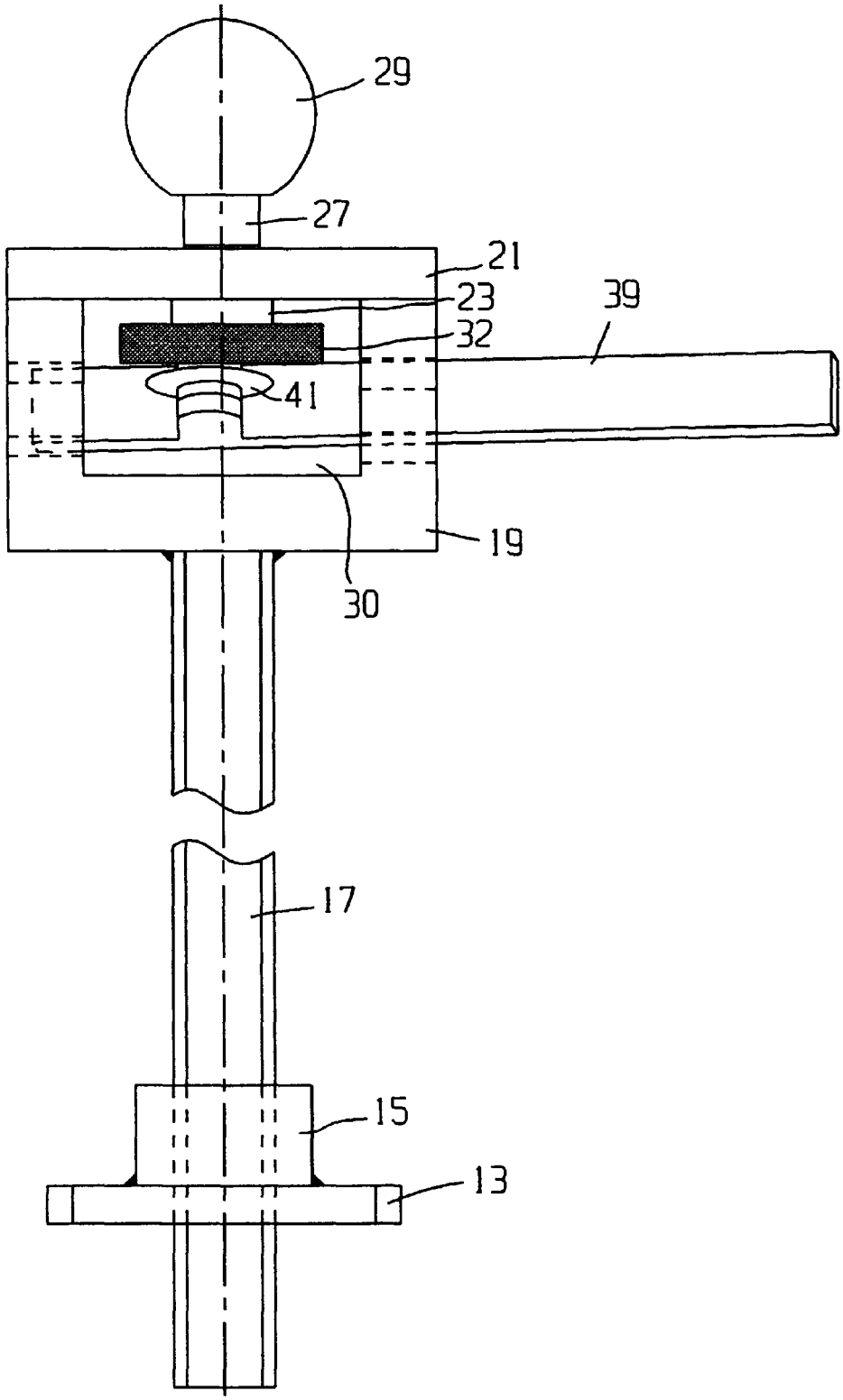
FIG. 1 is a cross sectional end view of the present invention.
Figure 2:
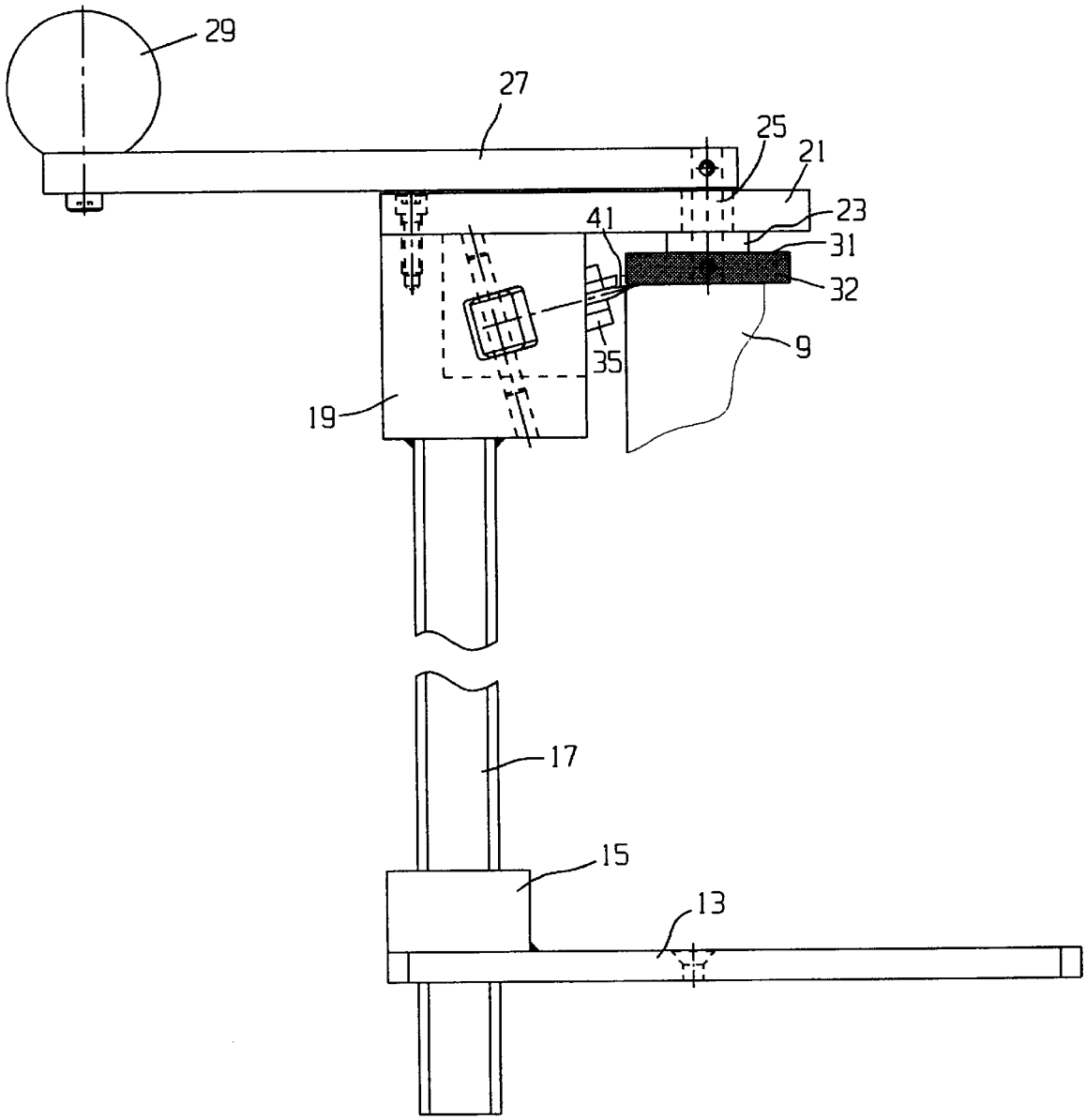
FIG. 2 is a partially cut-away side view of the present invention.

Referring to the drawings wherein like reference characters designate like or corresponding parts throughout the several views, and referring particularly to FIGS. 1 and 2 it is seen that the invention generally 10, includes a surface mountable base or foot 13 attached to a support section 15 having a vertical bore 16 therethrough. A vertical rod or neck member 17 is provided for slidable engagement through bore 16 of support member 15. A chassis or head 19 is provided at one end of rod 17. An outwardly extending horizontal flange 21 is attached to the top of chassis 19 such that it protrudes out over foot 13.

A second vertical bore 25 is provided in the portion of flange 21 which extends outwardly away from chassis 19 for receiving a rotatable shaft 23. An elongated crank arm 27 with handle 29 is attached to the upper end of shaft 23 above flange 21. A disk 31 having a knurled edge 32 is attached to the lower end of shaft 23 below flange 21. In an alternative embodiment, in place of arm 27, shaft 23 may instead be attached to a motor or other automatic means to impart rotational motion to said shaft.

Figure 5:
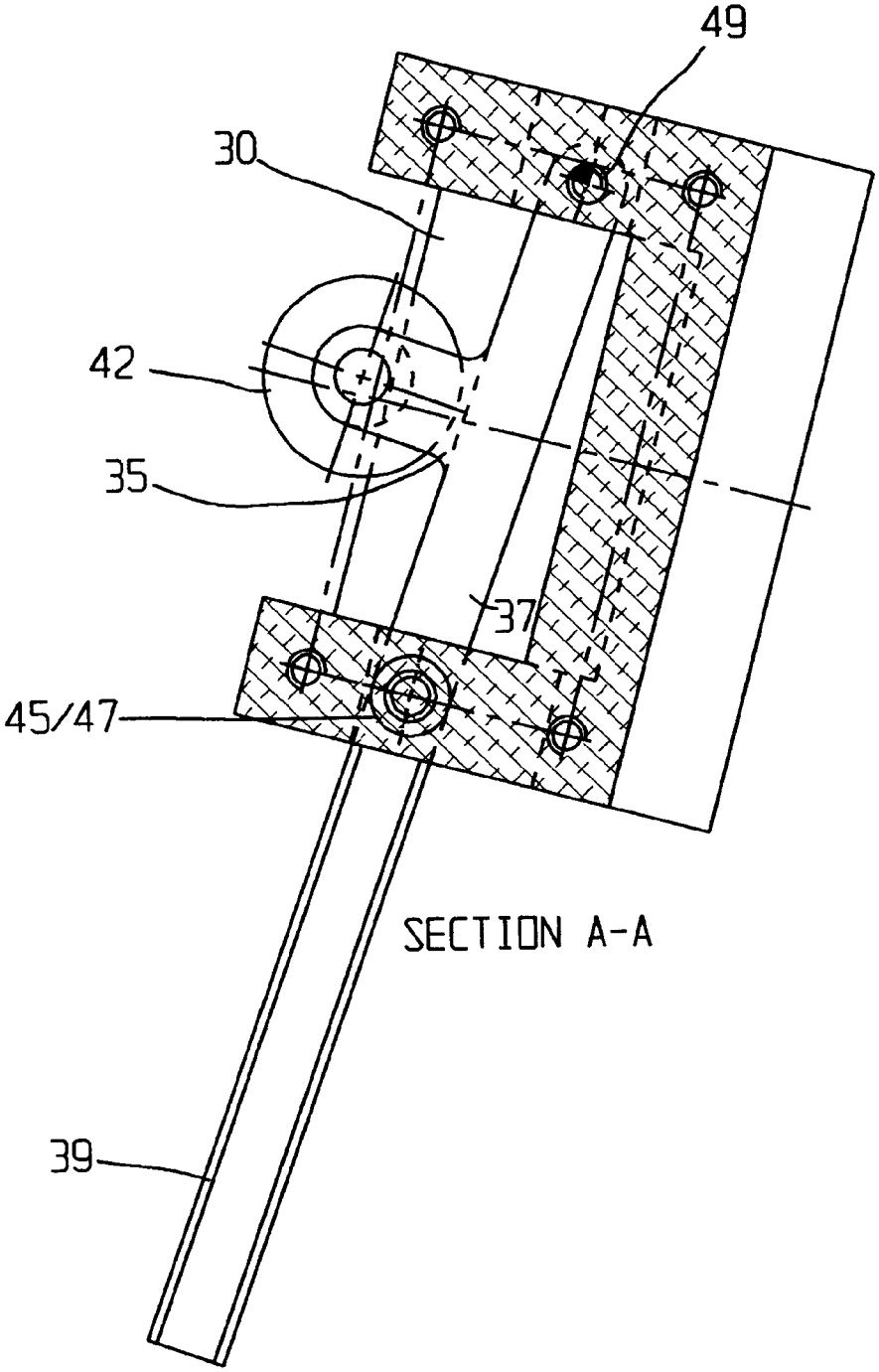
FIG. 5 is a cross-sectional view along line A—A of FIG. 4.

Inside chassis 19 a large opening 30 is provided for holding movable blade support 35 and blade 41. Support 35 has an adjustable shuttle mount 37 which is pivotally attached inside the chassis opening at 49 for alternating between an extended and retracted position. A shuttle arm 39 is attached to mount 37 allowing the user to move the mount 37, and hence the blade support 35 and blade 41, back and forth (see FIG. 5). A locking dimple 45 is provided in opening 30 which corresponds to a spring-loaded ball lock 47 on mount 37 for holding mount 37 in place when it is in the extended position for cutting into a can. Dimple 45 and lock 47 may be replaced with any other suitable retaining means for holding the shuttle mount in place while the blade is extended.

Figure 3:
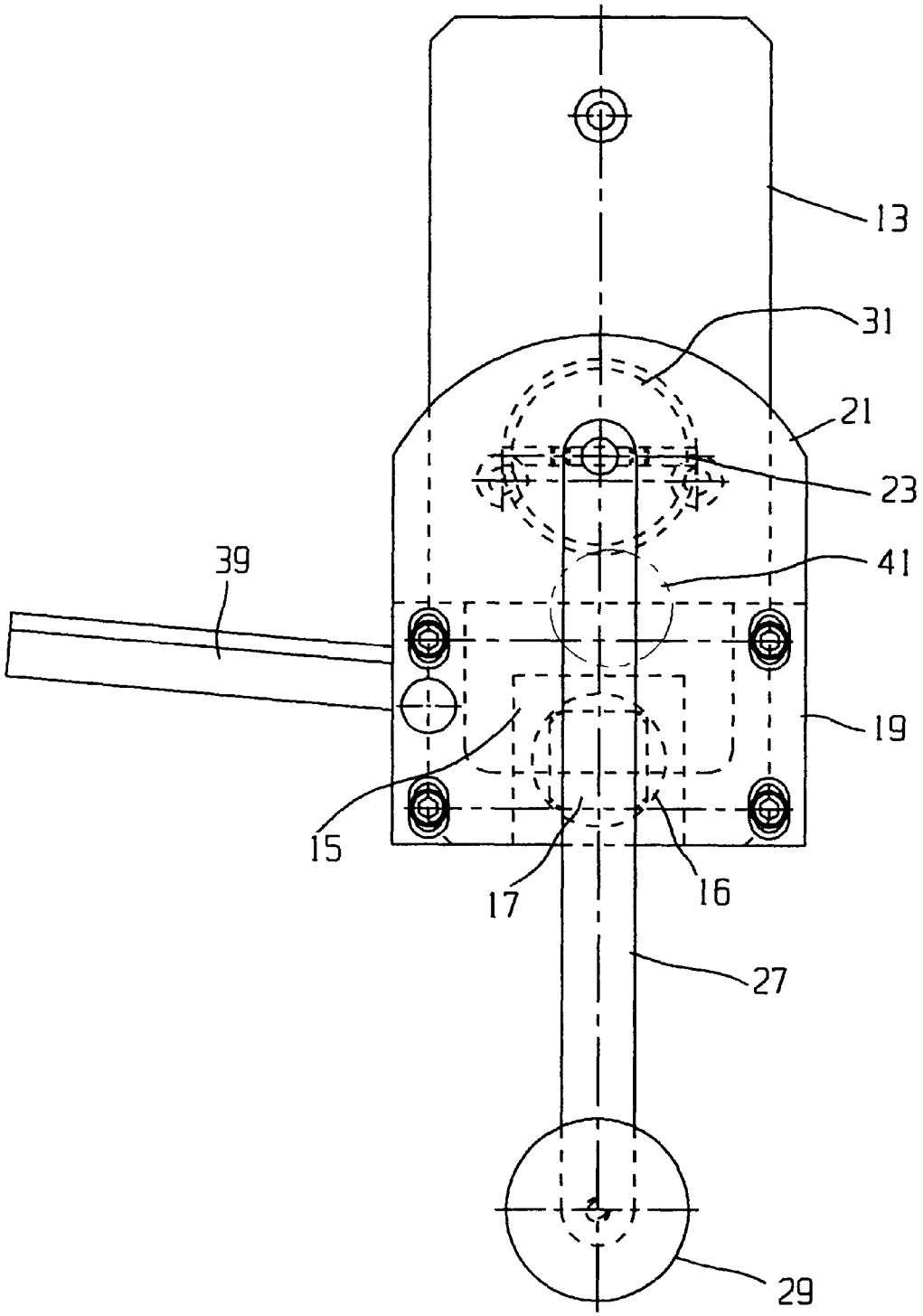
FIG. 3 is a partially cut-away top view of the present invention.
Figure 4:
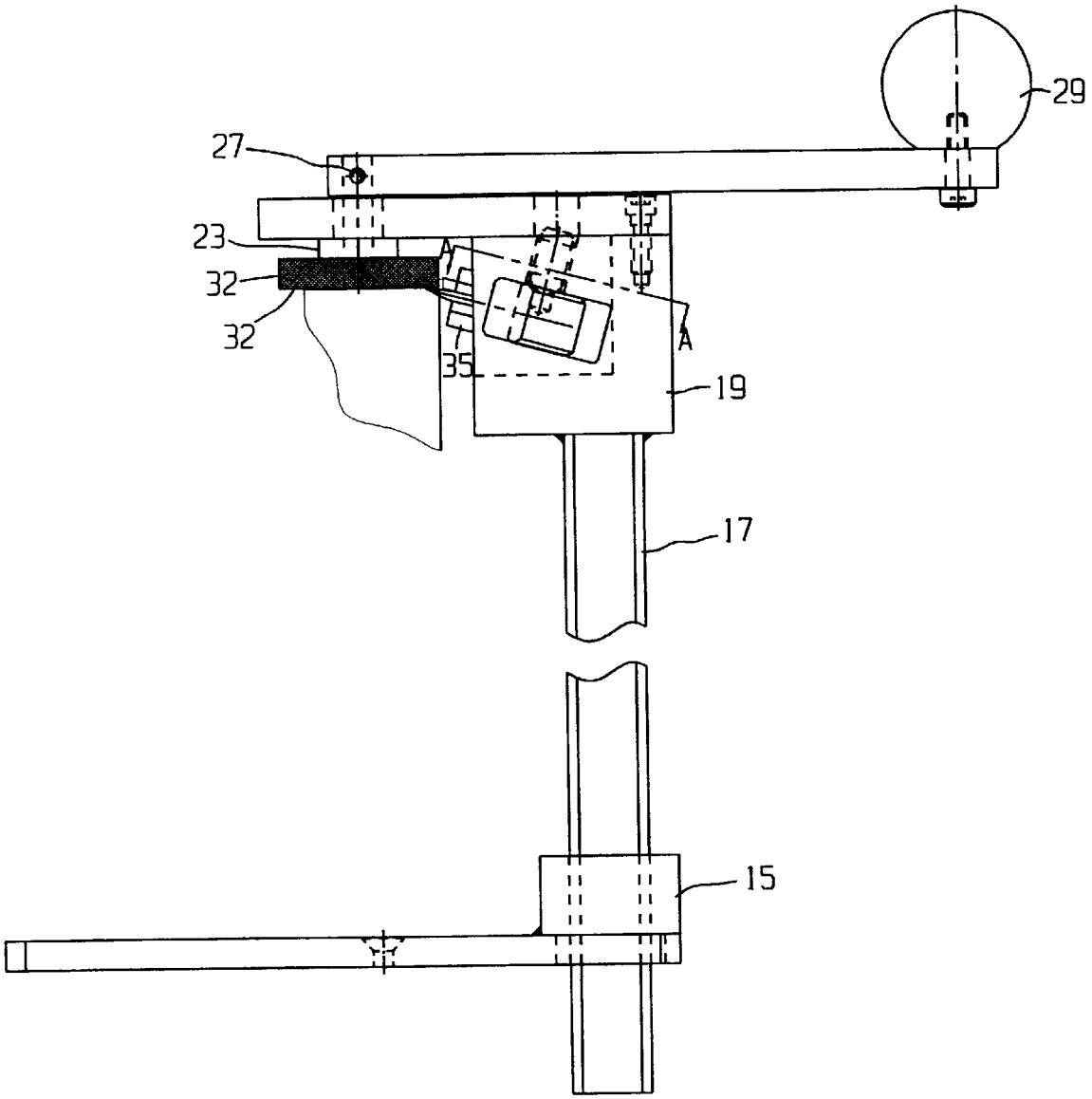
FIG. 4 is a partially cut-away opposite side view of the invention shown in FIG. 2.
Figure 6:
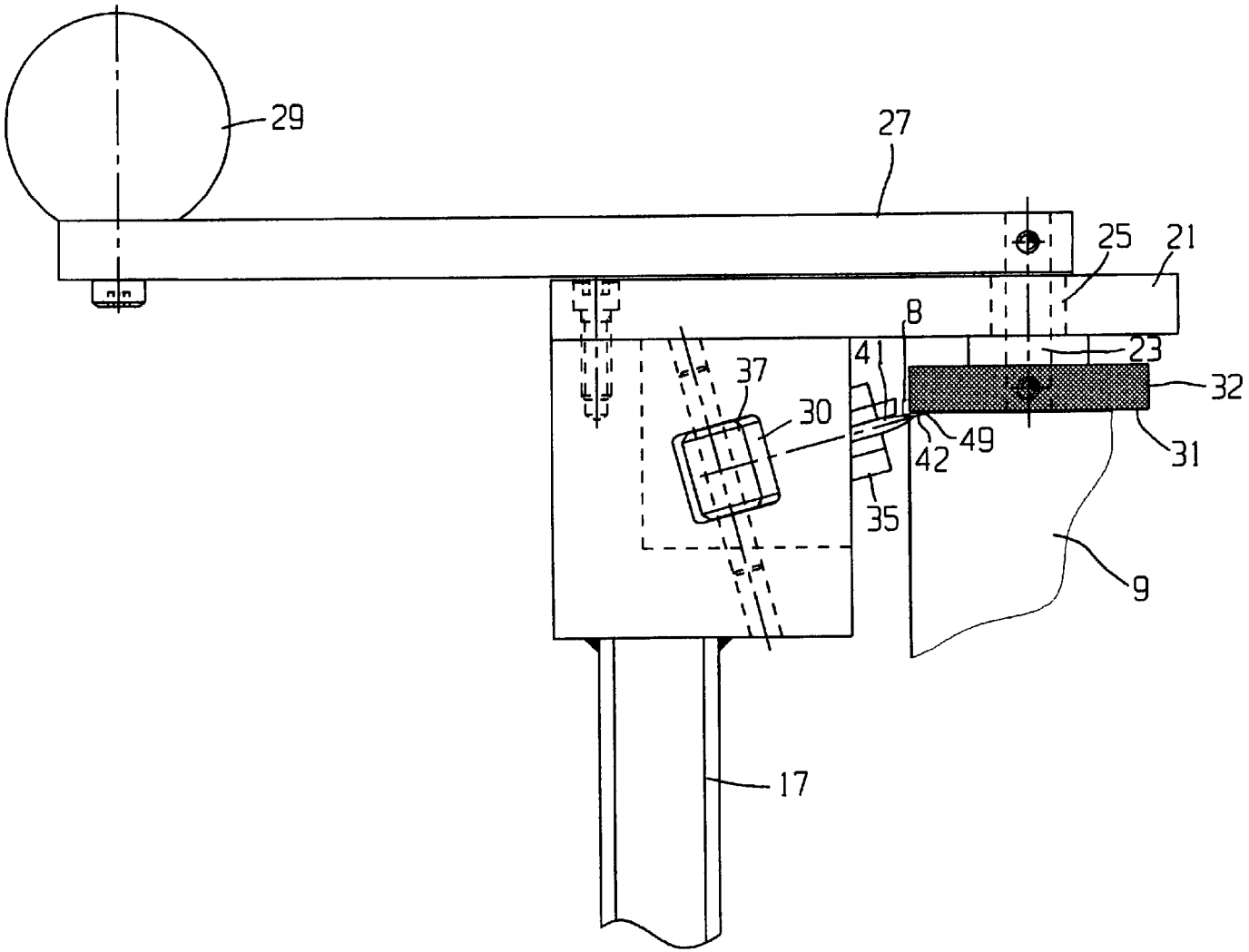
FIG. 6 is an enlarged view of FIG. 2.

Circular blade 41 is rotatably mounted on support 35. Blade 41 has tapered upper and lower surfaces which form a pointed annular edge 42 for piercing through the outer cylindrical body of a can or drum 9. Blade 41 is mounted on support 35 such that it is offset from the axis defined by shaft 17 and disk 31 (see FIG. 3). This offset orientation causes the cylindrical container to be forced into the blade (as opposed to away from it) as it rotates, thereby facilitating a continuous cut. Blade 41 is mounted at an upward angle and tapered at its outer edges. Because of this construction, when edge 42 pierces the vertically oriented can 9 just below the annular lip 8 (see FIG. 6), it does so at an angle. As it cuts, the angle and the tapering of the blade cause the newly-cut edge of the can adjacent to the lid to bend in an inward direction. As a result, instead of leaving a sharp downwardly pointing lip on the newly-cut lid, this lip is bent up and inward so that the lid is safe to handle.

To use the invention, the foot 13 must be firmly mounted to a level planar surface. The head assembly is attached at the top of vertical rod 17 which is slidably threaded into bore 16. The assembly is raised enough to allow a cylindrical metallic container or can 9 to be placed on foot 13. The assembly is then lowered such that disk 31 rests on the top of the can lid adjacent to the upper annular rim or seam 8. Arm 39 is then shuttled forward and locked into place (see FIG. 5), causing blade 41 to pierce the body of can 9 just below seam 8 (see FIG. 6). Crank 27 is then operated causing disk 31 to rotate. The knurled outer edge 32 of disk 31 provides the necessary frictional force to rotate the can. As the can rotates, blade 41 makes a circumferential cut just below seam 8 in which the upper edge of the lid is bent back so that no sharp edge is exposed on the lid.

In an alternative embodiment, a motor or other automatic means may be employed to operate the crank. An electronic measuring means may also be employed to spin the can 360 degrees in order to complete each cut. In another alternative embodiment, the shuttling extension and retraction of blade 41 may be motorized, automatic or even computer controlled.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

We claim:

1. An apparatus for opening a cylindrical metallic container comprising a horizontal surface-mountable base having an opening at one end thereof, a vertical rod having a head assembly at its upper end slidably disposed in said base opening, said head assembly including an upper horizontal flange which extends over said base, said flange supporting a crank attached to a rotatable disk, a cavity in said head assembly, a pivotally mounted member provided in said cavity, said member being movable between a retracted and extended position, and a circular blade rotatably attached to said member such that said blade is offset from the central axis defined by said vertical rod, said blade being positioned at an upward angle relative to the horizontal, the outer edges of the upper and lower surfaces of said circular blade being tapered together to form a sharp annular edge.

2. The apparatus of claim 1 wherein a frictional locking device is provided on said pivotally mounted member for holding said member firmly in place while in the extended position.

3. An apparatus for opening a can comprising a horizontal base attached to a slidable vertical rod, a head assembly at the top of said rod, a flange on said head assembly, a crank supported by said flange, a rotatable disk attached to said crank, and a circular blade rotatably attached to a mounting member in said head such that said blade is offset from the central axis defined by said vertical rod, said blade being positioned at an upward angle relative to the horizontal, the outer edges of the upper and lower surfaces of said circular blade being tapered together to form a sharp annular edge, said mounting member being movable between a retracted and extended position.

4. The apparatus of claim 3 wherein a frictional locking device is provided on said pivotally mounted member for holding said member firmly in place while in the extended position.

* * * * *